United States Patent [19]

Kido et al.

[11] 4,032,348

[45] June 28, 1977

[54] METHOD FOR FORMING PHASE HOLOGRAMS

[75] Inventors: Keishiro Kido; Masayoshi Tsuboi; Noboru Arai, all of Asaka, Japan

[73] Assignee: Fuji Photo Film Co., Ltd., Minami-ashigara, Japan

[22] Filed: Oct. 30, 1975

[21] Appl. No.: 627,316

[30] Foreign Application Priority Data

Oct. 30, 1974 Japan ..... 49-125036

[52] U.S. Cl. ..... 96/60 R; 96/27 H

[51] Int. Cl.[2] ..... G03C 5/32; G03C 5/04

[58] Field of Search ..... 96/60 R, 27 H

[56] References Cited

UNITED STATES PATENTS

| | | | |
|---|---|---|---|
| 2,611,700 | 9/1952 | Brunner et al. | 96/60 R |
| 3,948,659 | 4/1976 | Yamaguchi et al. | 96/60 R |

*Primary Examiner*—Mary F. Kelley

*Attorney, Agent, or Firm*—Sughrue, Rothwell, Mion, Zinn & Macpeak

[57] ABSTRACT

A method for producing a phase hologram by bleaching a silver image of an amplitude hologram formed on a light-sensitive silver halide photographic material, wherein the bleaching is conducted using a solution containing an N-halogeno compound to inhibit the binder of the layer having the silver image therein from swelling.

11 Claims, 1 Drawing Figure

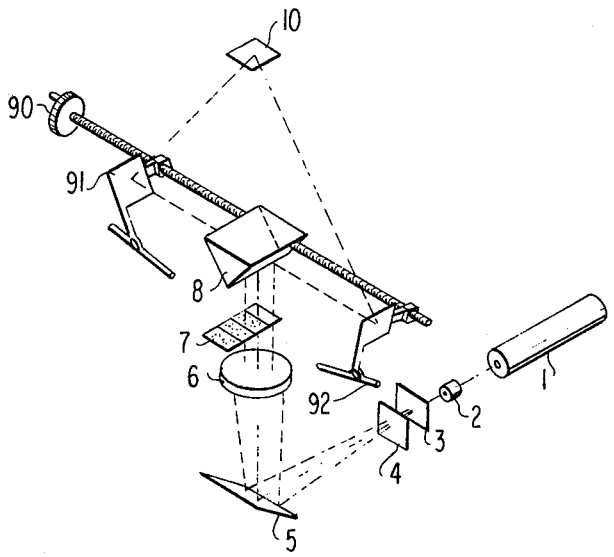
10
90
91
8
7
6
92
2
1
3
4
5

METHOD FOR FORMING PHASE HOLOGRAMS

BACKGROUND OF THE INVENTION

1. Field of the Invention

The present invention relates to a method for forming a phase hologram. Particularly, it relates to a method for forming a phase hologram by bleaching an amplitude hologram recorded on a silver halide photographic material.

2. Description of the Prior Art

An amplitude hologram (represented by an amplitude transmittance distribution) is obtained by exposing a silver halide photographic material to an interference fringe formed by coherent light beams, developing and fixing the photographic material to form a silver image (interface fringe). The silver which comprises the amplitude hologram can be converted into a transparent silver compound by bleaching to produce a phase hologram in which the refractive index of the silver compound differs from the refractive index of the binder.

Since an amplitude hologram represents an imagewise distribution of amplitude transmittance, the brightness of a reconstructed image from an amplitude hologram is small as compared to a phase hologram. One of the principal factors which influences the characteristics of a hologram is the diffraction efficiency (represented by $\eta\eta = (I_1 I) \times 100$ (%), wherein I designates incident light power and $I_1$ the transmission first order diffraction light power). A phase hologram, which provides a bright reconstructed image, provides a much higher $\eta$ value as compared with an amplitude hologram.

Heretofore, attempts have been made to bleach holograms using ammonium dichromate, potassium ferricyanide, mercuric chloride, or copper bromide, as are used in conventional photographic processing, as described in *Applied Optics*, Vol. 7, p. 2409 (1968), Vol. 8, p. 85 (1969) and Vol. 9, p. 1363 (1970).

Although phase holograms produced using conventional bleaching treatments provide a high diffraction efficiency, the light resistance thereof is poor and silver compounds of most of these holograms are blackened (printed-out) by the light used for reconstruction.

Of these conventional treatments, the treatment wherein the silver developed is converted into silver iodide has been considered to provide a phase hologram having relatively good light resistance (for example, bleaching treatment R-10, developed by Eastman Kodak Co.: a bleaching treatment using a solution prepared by mixing an aqueous solution of sulfuric acid containing ammonium dichromate and an aqueous solution of potassium iodide). However, with this method, the silver developed is not completely converted into silver iodide, and impurities are likely to act as nuclei which cause print-out and blacken bleached areas. Further, when the above-described silver compound is converted into silver iodide, crystal growth occurs and the resultant hologram has the disadvantage that the light scattering thereof is increased.

SUMMARY OF THE INVENTION

It is, therefore, one object of the present invention to provide a method for producing a phase hologram using an amplitude hologram.

Another object of the present invention is to provide a method for producing a phase hologram having good light resistance and high diffraction efficiency.

The above-described objects of the invention are attained with a method for producing a phase hologram by bleaching the silver image of an amplitude hologram formed on a silver halide photographic light-sensitive material, wherein the bleaching is conducted using a solution containing an N-halogeno compound which inhibits the binder of the layer having the silver image therein from swelling.

BRIEF DESCRIPTION OF THE DRAWING

The FIGURE illustrates an optical system constructed by main parts for a device to produce an amplitude hologram.

In the FIGURE, 1 designates a laser generator, 2 a collimating lens, 3 a pinhole, 4 a shutter, 5 a reflecting mirror, 6 a collimating lens, 7 an optical wedge, 8 a splitting mirror, 90 a spatial frequency dial, 91 and 92 reflecting mirrors and 10 an exposure stage.

DETAILED DESCRIPTION OF THE INVENTION

The hologram material which can be used in the present invention comprises a support (e.g., glass, silica, silicon single crystal, sapphire, high melting point polymer, etc.) having thereon a silver halide emulsion layer.

The silver halide emulsion can be obtained by dispersing silver halide in an water-soluble binder. Illustrative silver halides are silver chloride, silver bromide, silver iodide, silver chlorobromide, silver iodobromide, silver chloroiodobromide, mixtures thereof, etc.

A typical silver halide emulsion contains about 90 mol% or more silver bromide (preferably containing not more than 5 mol% silver iodide) and contains silver halide grains of a mean grain size of not more than 0.1 $\mu$ (a so-called Lippmann emulsion), and in which the weight ratio of silver halide to water-soluble binder is about 1:4 to about 6:1.

Another example of a silver halide emulsion is an emulsion which contains about 50 mol% or more (preferably 70 mol% or more) silver chloride and contains silver halide grains of a mean grain size of not more than about 1.0 $\mu$.

Examples of water-soluble binders include, gelatin, colloidal albumin, casein, cellulose derivatives (e.g., carboxymethyl cellulose, hydroxyethyl cellulose, etc.), saccharide derivatives (e.g., agar-agar, sodium alginate, starch derivative, etc.), synthetic hydrophilic colloids (e.g., polyvinyl alcohol, poly-N-vinyl pyrrolidone, polyacrylic acid copolymers, polyacrylamide, derivatives thereof, etc.). If desired, a compatible mixture of two or more of these binders can be used. Of these, the most preferred binder is gelatin. Gelatin can be replaced, partly or completely, by a synthetic high molecular weight substance, by a gelatin derivative (prepared by processing gelatin with a compound having a group capable of reacting with the functional groups contained in the gelatin molecule (i.e., amino groups, imino groups, hydroxy groups or carboxy groups)), or by a graft polymer prepared by grafting a molecular chain of another high molecular weight substance onto gelatin.

Suitable compounds for preparing the gelatin derivatives are isocyanates, acid chlorides and acid anhydrides as described in U.S. Pat. No. 2,614,928, acid anhydrides as described in U.S. Pat. No. 3,118,766, bromoacetic acids as described in Japanese Pat. No. 5514/64, phenyl glycidyl ethers as described in Japanese Pat. No. 21845/67, vinyl sulfone compounds as described in U.S. Pat. No. 3,132,945, N-allylvinylsulfonamides as described in British Pat. No. 861,414, maleinimide compounds as described in U.S. Pat. No. 3,186,846, acrylonitriles as described in U.S. Pat. No. 2,594,293, polyalkylene oxides as described in U.S. Pat. No. 3,312,553, epoxy compounds as described in Japanese Pat. No. 26845/67, acid esters as described in U.S. Pat. No. 2,763,639, alkanesultones as described in British Pat. No. 1,033,189, and the like.

Illustrative high molecular weight polymers which can be grafted onto gelatin are given in U.S. Pat. Nos. 2,763,625, 2,831,767, 2,966,884, *Polymer Letters*, 5, 595 (1967), *Phot. Sci. Eng.*, 9, 148 (1965), *J. Polymer Sci.* A-1, 9, 3199 (1971), and the like.

Homopolymers or copolymers of compounds which are generally called vinyl monomers, such as acrylic acid, methacrylic acid, the ester, amide, and nitrile derivatives thereof, styrene, etc., are widely used for grafting onto gelatin.

Hydrophilic vinyl polymers having some compatibility with gelatin, such as homopolymers or copolymers of acrylic acid, acrylamide, methacrylamide, hydroxyalkyl acrylates, hydroxyalkyl methacrylates, etc., are particularly preferred.

The silver halide emulsion is advantageously optically sensitized with known optical sensitizers such as the cyanine dyes and merocyanine dyes as described in U.S. Pat. Nos. 1,346,301, 1,846,302, 1,942,854, 1,990,507, 2,493,747, 2,739,964, 2,493,748, 2,503,776, 2,519,001, 2,666,761, 2,734,900, 2,739,149, and British Pat. No. 450,958.

The silver halide emulsion can be suitably exposed with electromagnetic radiation to which the silver halide emulsion is sensitive, e.g., visible light, ultraviolet light, electron beams, etc. With optically sensitized photographic light-sensitive materials, it is convenient to select light mainly having a wavelength corresponding to the optically sensitized region of the emulsion as the light for exposing the emulsion layer.

The emulsion is advantageously chemically sensitized with salts of noble metals such as ruthenium, rhodium, palladium, iridium, platinum, etc., as described in U.S. Pat. Nos. 2,448,060, 2,566,245, and 2,566,262. The emulsion can also be chemically sensitized with a gold salt as described in U.S. Pat. No. 2,339,083, or stabilized with a gold salt as described in U.S. Pat. Nos. 2,597,856 and 2,597,915. Furthermore, a thiopolymer as described in U.S. Pat. No. 3,046,129 can advantageously be added to the emulsion. In addition, the emulsion can be stabilized with mercury compounds as described in U.S. Pat. No. 3,046,129, column 20, line 51 to column 21, line 3, triazoles, azaindenes, disulfides, quaternary benzothiazolium compounds, zinc salts and cadmium salts.

The emulsion can contain light-absorbing dyes as described in U.S. Pat. Nos. 2,527,583, 2,611,696, 3,247,127, 3,260,601, etc., if desired.

The emulsion is advantageously hardened with a suitable hardening agent for hydrophilic colloids, such as formaldehyde or a like hardener; halogen-substituted fatty acids (e.g., mucobromic acid, etc.); compounds having a plurality of acid anhydride groups; methanesulfonic acid bisester; dialdehydes or sodium bisulfate adducts thereof such as $\beta$-methylglutaraldehyde bissodium bisulfite; bisaziridinecarboxyamides (e.g., trimethylenebis(1-aziridinecarboxyamide)); triazine derivatives (e.g., 2-hydroxy-4,6-dichloro-s-triazine, etc.); and the like.

The silver halide emulsion is coated on a substrate as it is or after adding a conventional coating aid as described in U.S. Pat. No. 3,046,129, etc., thereto. The silver halide emulsion layer can be coated in monolayer or multi-layer on the substrate, if desired.

Further, a conventional backing layer, antihalation layer, interlayer, uppermost layer (e.g., a protective layer, etc.) or the like can be provided on the substrate or on the emulsion, if desired.

The thus obtained silver halide photographic light-sensitive material is subjected to the following processings to obtain an amplitude hologram which can be used in the present invention.

An amplitude hologram can be produced by exposing the silver halide photographic light-sensitive material to a laser beam using, for example, an apparatus having the components as shown in FIG. 1, and subjecting the exposed material to developing, fixing and rinsing with water as in conventional photographic processing.

In the FIGURE, 1 designates a laser generator, 2 a collimating lens, 3 a pinhole, and 4 a shutter, these devices being aligned in the direction of the laser beam generated by laser generator 1. Once the laser beam passes these devices its direction is changed by reflection mirror 5 so that the laser beam passes through collimating lens 6, which converges the laser beam into a parallel light beam. The parallel light laser beam then passes through optical wedge 7 and is then divided into two beams by splitting mirror 8. These two beams are reflected by reflection mirrors 91 and 92, respectively, connected to spatial dial 90, and reach exposure stage 10 to yield an interference fringe. The light-sensitive material is mounted on the exposure stage 10 in a manner so as to be exposed to the interference fringe.

The thus obtained amplitude hologram comprises a hologramic silver image formed in the photographic light-sensitive layer (accordingly, the photographic light-sensitive layer is designated "hologram layer").

Developing agents which can be used in the method of the present invention for forming silver images are well known in the art, and include developing agents such as the dihydroxybenzenes (e.g., hydroquinone, chlorohydroquinone, bromohydroquinone, isopropylhydroquinone, toluhydroquinone, methylhydroquinone, 2,2,-dichlorohydroquinone, 2,5-dimethylhydroquinone, etc.), the 3-pyrazolidones (e.g., 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone, 1-phenyl-5-methyl-3-pyrazolidone, etc.), the aminophenols (e.g., o-aminophenol, p-aminophenol, N-methyl-o-aminophenol, N-methyl-p-aminophenol, 2,4-diaminophenol, etc.), pyrogallol, ascorbic acid, the 1-aryl-3-aminopyrazolines (e.g., 1-(p-hydroxyphenyl)-3-aminopyrazoline, 1-(p-methylaminophenyl)-3-pyrazoline, 1-(p-aminophenyl)-3-pyrazoline, 1-(p-amino-m-methylphenyl)-3-aminopyrazoline, etc.), and mixtures thereof. The developer generally possesses a pH of not less than about 8, preferably about 8.5 to 12.5.

The developer can contain, if desired, conventional additives such as a preservative (e.g., a sulfite, a bisulfite, etc.), a buffer (e.g., a carbonate, boric acid, a borate, an alkanolamine, etc.), an alkali agent (e.g., a hydroxide, a carbonate, etc.), a dissolving aid (e.g., polyethylene glycol, etc.), a pH-adjusting agent (e.g., acetic acid or a like organic acid, etc.), a sensitizing agent (e.g., a quaternary ammonium salt, etc.), a development accelerator, a surface active agent, etc., in conventional amounts.

The developed hologram is then subjected to a conventional fixing. Illustrative fixing agents for the silver halide include the generally well known solvents for silver halide, such as a water-soluble thiosulfate (e.g., potassium thiosulfate, sodium thiosulfate, ammonium thiosulfate, etc.), a water-soluble thiocyanate (e.g., potassium thiocyanate, sodium thiocyanate, ammonium thiocyanate, etc.), a water-soluble organic diol (e.g., 3-thia-1,5-pentanediol, 3,6-dithia-1,8-octanediol, 3,6,9-trithia-1,11-undecanediol, 3,6,9,12-tetrathia-1,14-tetradecanediol, etc.), a water-soluble sulfur-containing organic dibasic acid (e.g., ethylenebisthioglycolic acid, etc.) and a water-soluble salt thereof, or mixtures thereof, which are used in conventional amounts.

The fixing agent-containing solution can contain, if desired, conventional additives such as a preservative (e.g., a sulfate, a bisulfate, etc.), a pH-buffer (e.g., boric acid, a borate, etc.), a pH-adjusting agent (e.g., acetic acid, etc.), a chelating agent, etc.

One preferred requirement for the hologram layer of the amplitude hologram used in the present invention is that the contrast of the silver image be high, that is, the degree of modulation and the image density be high. This property is affected by the thickness of the hologram layer. A thick hologram layer, in general, provides a better result; the thickness of the hologram layer usually ranges from about 5 to about 15 $\mu$.

The hologram layer should faithfully reproduce the interference fringe formed during exposure, however, the hologram layer of a silver halide photographic light-sensitive material is usually subjected to various processes such as development, fixing, and, further, bleaching to convert an amplitude hologram into a phase hologram, and the shape of the original interference fringe is changed when the silver halide is converted to silver or when the silver image is converted to a silver compound, thereby lowering the fidelity of the hologram. This change in shape is affected by the rate of swelling of the binder and the speed of reaction in processing; accordingly, the rate of swelling and the speed of reaction must be kept low.

In the present invention a mixture of a liquid which moderately swells the binder of the hologram layer, an N-halogeno compound and a solvent therefor can be used as the bleaching solution to bleach the silver image which comprises the amplitude hologram, or a solution prepared by dissolving an N-halogeno compound in a solvent therefor which moderately swells the binder of the hologram layer can be used as the bleaching solution.

N-halogeno compounds which can be used in the present invention include compounds represented by the following general formula (I) or (II). These N-halogeno compounds can be used separately or as a combination of two or more thereof.

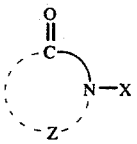

(I)

-continued

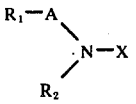

(II)

In the above general formulae (I) and (II), X represents a halogen atom (e.g., chlorine, bromine, iodine), SCN or CN. N-halogeno compounds having a halogen atom as X are preferred, particularly those having chlorine or bromine.

Z represents the atoms necessary for forming a five- or six-membered ring with the

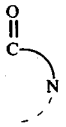

moiety, which five- or six-membered ring can be condensed with another ring or rings, if desired. Examples of such five- or six-membered rings are a pyrrole ring, a pyrroline ring, a pyrrolidine ring, an imidazole ring, an imidazoline ring, an imidazolidine ring, a pyrazole ring, a pyrazoline ring, a pyrazolidine ring, a triazole ring, a tetrazole ring, a piperidine ring, an oxazine ring, a thiazine ring, a piperazine ring, a hydantoin ring, a cyanur ring, a thiohydantoin ring, a hexahydrotriazine ring, an indole ring, an indoline ring, an isoindole ring, a benzimidazole ring, a carbozole ring, a phenoxazine ring, a purine ring, etc.

Further, the term "5- or 6-membered ring" as these terms are used herein includes rings which are substituted with, e.g., an alkyl group, an aryl group, an alkoxyl group, a halogen atom, oxygen (=O), sulfur (=S), etc.

The above-described alkyl group preferably includes those having 1 to 12 carbon atoms such as methyl, ethyl, propyl, isopropyl, butyl, isobutyl, t-butyl, pentyl, amyl, hexyl, 2-ethylhexyl, octyl, nonyl, decyl, dodecyl, etc., and more preferably, those having 1 to 8 carbon atoms.

Suitable aryl groups include mono- and poly-aryl groups such as a phenyl group and naphthyl groups. The term aryl groups includes substituted or unsubstituted aryl groups, e.g., with a substitutent such as, e.g., an alkyl group having 1 to 4 carbon atoms such as methyl, ethyl, propyl, isopropyl, butyl, t-butyl, etc., a halogen atom such as chlorine, bromine, iodine, etc.

Suitable alkoxyl group include those having 1 to 12 carbon atoms such as methoxy, ethoxy, propoxy, isopropoxy, butoxy, t-butoxy, pentoxy, hexoxy, octoxy, and dodecyloxy, and most preferably, those having 1 to 8 carbon atoms.

A represents a carbonyl group or a sulfonyl group.

$R_1$ and $R_2$ represent the same or different alkyl groups, aryl groups or alkoxyl groups, where alkyl groups and alkoxyl groups having 1 to 12 carbon atoms are preferred, especially those having 1 to 8 carbon atoms as described above. Suitable aryl groups include those above(unsubstituted or substituted phenyl groups or naphthyl groups).

Halogenated melamines are examples of additional N-halogeno compounds suitable for use in the present invention.

Specific examples of N-halogeno compounds suitable for the present invention are as follows:

1. N-bromosuccinimide
2. N-bromotetrafluorosuccinimide
3. N-bromophthalimide
4. N-bromoglutarimide
5. 1-bromo-3,5,5-trimethyl-2,4-imidazolidinedion
6. 1,3-dibromo-5,5-dimethyl-2,4-imidazolidinedion
7. N,N'-dibromo-5,5-diethylbarbituric acid
8. N,N'-dibromobarbituric acid
9. N-bromoisocyanuric acid
10. N-bromoacetamide
11. N-bromochloroacetamide
12. N-bromotrifluoroacetamide
13. N-bromoacetanilide
14. N-bromobenzenesulfonylanilide
15. N-bromobenzamide
16. N-bromobenzenesulfonylamide
17. N-bromo-N-benzenesulfonylbenzenesulfonylamide
18. N-bromophthalazone
19. N-chlorosuccinimide
20. N-iodosuccinimide
21. trichloroisocyanuric acid
22. N-chlorophthalimide
23. 1,3-dichloro-5,5-dimethyl-2,4-imidazolidinedion
24. 3-chloro-5,5-dimethyl-2,4-imidazolidinedion
25. 1,3-diiodo-5,5-dimethyl-2,4-imidazolidinedion
26. trichloromelamine
27. tribromomelamine
28. N-bromocyclohexanedicarbonimide
29. 1-bromo-3,5,5-triethyl-2,4-imidazolidinedion
30. 1-bromo-3-ethyl-5,5-dimethyl-2,4-imidazolidinedion
31. 1,3-dibromo-5,5-diethyl-2,4-imidazolidinedion
32. N,N-dibromo-5,5-dimethylbarbituric acid
33. N,N-dibromo-5-ethyl-5-methylbarbituric acid
34. N,N-dibromo-5-ethyl-5-phenylbarbituric acid
35. N,N'-dibromoisocyanuric acid
36. N-bromobromoacetamide
37. N-bromonaphthoamide
38. N-bromohydroxybenzamide
39. N-bromocarboxybenzamide
40. N-bromotoluenesulfonamide
41. N-bromo-N-toluenesulfonylamide
42. 1-bromo-3,5,5-trimethyl-2,4-imidazolidinedion
43. 1-bromo-3,5,5-triethyl-2,4-imidazolidinedithion
44. 1-bromo-3-ethyl-5,5-dimethyl-2,4-imidazolidinedithion
45. 1,3-dibromo-5,5-dimethyl-2,4-imidazolidinedithion
46. 1,3-dibromo-5,5-diethyl-2,4-imidazolidinedithion
47. 1,3-dichloro-5,5-dimethyl-2,4-imidazolidinedithion
48. 3-chloro-5,5-dimethyl-2,4-imidazolidinedithion
49. 1,3-diiodide-5,5-dimethyl-2,4-imidazolidinedithion
50. N-bromosaccharin There are various liquids which can dissolve these N-halogeno compounds (that is, which are solvents for the N-halogeno compounds), for example, organic solvents such as alcohols (e.g., methanol, ethanol, isopropanol, etc.), benzene, toluene, xylene, cyclohexane, ethyl acetate, isoamyl acetate, ethylene bromide, ethylene chloride, n-heptane, isooctane, mesitylene, acetone, dimethylformamide, ethylene glycol monomethyl ether, glycerol, etc., and water.

It is quite preferred that these liquids be able to swell the binder of the hologram layer or be miscible with a liquid which can swell the binder of the hologram layer.

The necessary amount of swelling of the binder of the hologram layer in the present invention is to such an extent that the bleaching solution can penetrate into the binder layer and bleaching can proceed; increase in the amount of swelling more than this extent is not necessary and should be avoided.

In an ordinary bleaching treatment, the binder layer swells to more than 10 times the binder in the dry state. However, when rapid bleaching is carried out on such swollen binder layer, a large, spongy, bleached silver compound is formed and a phase hologram having high light scattering is obtained. Further, in the above-described rapid bleaching, impurities and crystal defects are easily formed in the bleached silver compound, and these impurities and defects act as print-out nuclei, providing a poor light resistance.

Therefore, in the present invention it is desired to control the amount of swelling of the binder of the hologram layer to about two to about three times that of the binder in dry state. Controlling the amount of swelling can be effected by changing the mixing ratio of the solvent for the N-halogeno compound used to the swelling agent for the binder. For example, when the binder is gelatin, water is a good swelling agent; accordingly, the amount of swelling is controlled by the mixing ratio of water to a liquid (e.g., ethyl alcohol) which is miscible with water and which is a solvent for an N-halgeno compound. When a solvent (e.g., benzene) for an N-halogeno compound which is not miscible with water is used, a solvent (e.g., isopropyl alcohol) which is miscible with both the solvent and water can be used.

N-halogeno compounds are known as a halogenation agents for organic compounds (for example, see *Bromide and its Compounds*, p. 266 and p. 344, Ernest Benn Limited). N-halogeno compounds form a small amount of halogen radicals in an organic solvent, and further, these halogen radicals react to form hydrogen halide or halogen molecules, and thereby slowly bleach the silver pattern formed as an amplitude hologram without deforming the silver pattern, providing no spongy bleached silver compounds, impurities or crystal defects as described above.

As is described above, it is necessary that the component effective for bleaching react slowly with the silver pattern. When an organic solvent capable of forming a component effective for bleaching rapidly and in large amounts by decomposing an N-halogeno compound is used, the amount of the N-halogeno compound added to the solution containing the organic solvent should be decreased, or the N-halogeno compound should be added to the solution in small increments during bleaching, for example, using a metering pump. Further, an organic solvent having such a property may be replaced by a solvent which is more resistant to proton pull reaction. For example, when the binder of a hologram layer is gelatin and a solution containing N-bromosuccinimide dissolved in a mixture of isopropyl alcohol and water is used, isopropyl alcohol can be replaced by ethyl alcohol to decrease the speed of bleaching, or the amount of water can be decreased to reduce the amount of swelling of gelatin, whereby the penetration speed of the bleaching solution into the gelatin can be decreased to reduce the speed of bleaching.

Accordingly, a suitable amount of the N-halgeno compound or compounds added depends upon the type of solvent or solvents used for the N-halogeno compound(s), the mixing ratio of the solvent(s) to the swelling agent or agents for the binder of the hologram, or the reaction speed, and it is difficult to limit the range of the amount of the N-halogeno compound(s) added. However, at a reaction temperature ranging from room temperature to 40° C, a suitable amount of N-halogeno compound(s) ranges from about 0.2 to about 20% by weight of the solution of the solvent(s) for the N-halogeno compound(s) and the swelling agent(s) for the binder of the hologram layer, particularly, a range from 1 to 8% by weight is preferred since a higher diffraction efficiency and a moderate bleaching time can be obtained.

The amplitude hologram is immersed in thus prepared bleaching solution. The immersion time differs depending upon the reaction temperature, the concentration of the N-halogeno compound and the amount of the swelling agent for the binder of the hologram layer; however, at a temperature ranging from about room temperature to about 40° C, an immersion time of about 20 seconds to about 60 minutes is suitable. An immersion time of 5 to 40 minutes gives a higher diffraction efficiency and a relatively short processing time, and such an immersion time can be obtained by properly selecting the type of solvent for the N-halogeno compound and the amount of swelling agent for the binder of the hologram layer.

The bleached phase hologram obtained in the present invention is formed by bleaching an amplitude hologram obtained by a conventional method using a bleaching solution comprising an N-halogeno compound of the present invention and a special composition as described above. Accordingly, the phase hologram of the present invention possesses a higher light resistance and a large diffraction efficiency than phase holograms obtained using other bleaching solutions.

As described above, according to the present invention, the growth of silver halide crystals is slow and the bleaching time is fairly long since N-halogeno compounds which bleach slowly are used, and further the amount of swelling of the hologram layer is considerably suppressed. However, the silver image is completely bleached, and accordingly, silver halide particles are formed without light scattering. Further, no impurities are formed, and therefore, print-out based on impurities seldom occurs. For example, when a sample is exposed to light at an intensity of $1.5 \times 10^5$ lux from an ultra-high pressure mercury lamp of 150 w, blackening (print-out) of a phase hologram obtained using a conventional bleaching process (e.g., ferricyanide bleaching, dichromate bleaching, mercury (II) chloride bleaching, etc.) and a post-treatment with a potassium iodide aqueous solution becomes prominent in a few minutes, while a phase hologram obtained using a bleaching solution comprising an N-halogeno compound and an organic solvent shows no blackening even after such exposure for several hours, and further the diffraction efficiency of the hologram does not change before and after exposing.

The difference in light resistance between the bleaching of the present invention and a conventional bleaching is probably effected by factors such as the purity of the compound formed in the gelatin layer by bleaching and the perfectness of the crystals, and further the atmosphere of the crystals.

The following examples are given to illustrate the present invention in greater detail without limiting the same.

EXAMPLE 1

As a light-sensitive material, an ultra-fine particle silver halide photographic plate "Fuji UM Plate" (trade name; made by Fuji Photo Film Co., Ltd.) having an emulsion layer 5 $\mu$ thick was used. The light-sensitive material was exposed to an interference fringe using the apparatus shown in FIG. 1. The light-sensitive material was then developed (20° C, 5 min) using the commercially available developer for this plate "LD-735" (trade name; made by Fuji Photo Film Co., Ltd.) and then fixed, washed and dried in a conventional manner to obtain an amplitude hologram.

The light-sensitive material was then treated in a bleaching solution having the following composition.

| Bleaching Solution | |
|---|---|
| N-bromosuccinimide ($C_4H_4BrNO_2$) | 2 g |
| Ethanol | 100 ml |
| Distilled water | 25 ml |

The temperature of the bleaching solution was maintained at 20° C, and the amplitude hologram was immersed in the bleaching solution for 30 minutes with mild stirring.

The optical density of the silver image of the amplitude hologram before bleaching was 3.4.

The diffraction efficiency of the bleached phase hologram was 41%. This phase hologram is designated T-1 hereinafter.

The phase hologram was then subjected to a light resistance test. Light from an ultra-high pressure mercury lamp (150 w) was condensed to a circle of about 10 cm so that the light intensity at the surface of the test sample became $1.5 \times 10^5$ lux.

After exposing in this fashion for 30 minutes, no blackening was observed and the diffraction efficiency was the same before and after exposing.

| COMPARATIVE EXAMPLE 1 | |
|---|---|
| Solution A | |
| Ammonium dichromate | 120 g |
| Concentrated sulfuric acid | 14 ml |
| Water to make | 1 l |
| Solution B | |
| Potassium bromide | 92 g |
| Water to make | 1 l |

An amplitude hologram obtained in the same manner as described in Example 1 was immersed in a mixture of Solution A and Solution B using the conditions given in Example 1 to produce a phase hologram (designated C-1).

COMPARATIVE EXAMPLE 2

The same procedure as described in Comparative Example 1 was followed except for changing Solution B of Comparative Example 1 to a solution having the following composition to obtain a phase hologram (designated C-2).

| | |
|---|---|
| Sodium chloride | 45 g |
| Water to make | 1 l |

COMPARATIVE EXAMPLE 3

An amplitude hologram obtained in the same manner as described in Example 1 was immersed in a solution having the following composition for 20 minutes using the conditions given in Example 1.

| | |
|---|---|
| Ammonium dichromate | 20 g |
| Concentrated sulfuric acid | 14 ml |
| Water to make | 1 l |

The hologram was then taken out of the solution and rinsed with a solution having the following composition to obtain a phase hologram (designated C-3).

| | |
|---|---|
| Potassium iodide | 128 g |
| Water to make | 1 l |

COMPARATIVE EXAMPLE 4

Three amplitude holograms were formed in the same manner as described in Example 1. Each hologram was then immersed using the conditions given in Example 1 in one of the solutions having the following compositions to obtain phase holograms which were designated C-(*a*), C-(*b*) and C-(*c*), respectively.

| | |
|---|---|
| Solution (a) | |
| Potassium ferricyanide | 45 g |
| Potassium bromide | 20 g |
| Water to make | 1 l |
| Solution (b) | |
| Potassium ferricyanide | 45 g |
| Potassium iodide | 25 g |
| Water to make | 1 l |
| Solution (c) | |
| Potassium ferricyanide | 45 g |
| Potassium chloride | 20 g |
| Water to make | 1 ll |

The optical transmission densities of the silver images of the amplitude holograms formed in Comparative Examples 1 to 4 fell in the range of 2.8 to 3.0.

The characteristics of the seven phase holograms obtained in Example 1 and Comparative Examples 1 to 4 are shown in Table 1.

In Table 1, the Degree of Light Scattering was defined as follows: A border between black and white areas was viewed at a distance of 1 m through a hologram, and when the border could not be seen due to light scattering, the degree of light scattering was "large"; when a scattered border could be seen, "medium"; and when a very clear border could be seen, "small". Light resistance was measured using the same apparatus and procedure as described in Example 1.

TABLE 1

| Sample No. | Diffraction Efficiency % | Degree of Light cattering | Light Resistance |
|---|---|---|---|
| T-1 | 41 | Small | No blackening |
| C-1 | 35 | Medium | Blackening within 1 min. |
| C-2 | 28 | Medium | Blackening within 1 min. |
| C-3 | 30 | Large | Blackening within 30 min. |
| C-(a) | 35 | Medium | Blackening within 1 min. |
| C-(b) | 25 | Large | Blackening within 1 min. |
| C-(c) | 25 | Large | Blackening within 1 min. |

The phase holograms obtained by the method of the present invention possessed excellent characteristics in comparison with those obtained by other bleaching methods.

Besides the above-desribed conventional bleaching methods, the mercury (II) chloride method and the copper bromide method were tested; however, phase holograms obtained by these methods possessed a low diffraction efficiency (about 25%) and extremely bad light resistance, and accordingly, failed in use as a phase hologram.

EXAMPLE 2

An amplitude hologram was obtained in the same manner as described in Example 1.

The amplitude hologram was bleached for 30 minutes at room temperature using a bleaching solution having the following composition to obtain a phase hologram.

| | |
|---|---|
| Bleaching Solution | |
| N-bromoacetamide ($CH_3CONHBr$) | 2 g |
| Ethanol | 100 ml |
| Water | 25 ml |

The optical transmission density of the amplitude hologram was 2.82, and the diffraction efficiency was 42.5%. The same light resistance test as described in Example 1 was carried out, and no blackening or change in diffraction efficiency was observed.

EXAMPLE 3

An amplitude hologram was obtained in the same manner as described in Example 1, and then bleached for 30 minutes at room temperature using a bleaching solution having the following composition.

| | |
|---|---|
| Bleaching Solution | |
| N-iodosuccinimide ($(-CH_2CO)_2NI$) | 3 g |
| Ethanol | 100 ml |
| Water | 25 ml |

The optical transmission density of the amplitude hologram was 2.8, and the diffraction efficiency was 35%. A light resistance test was carried out using the same apparatus and conditions as described in Example 1 except exposing for 5 hours; no blackening or change in diffraction efficiency was observed.

EXAMPLE 4

An amplitude hologram was obtained in the same manner as described in Example 1, and then bleached for 15 minutes at 35° C in a bleaching solution having the following composition.

| | |
|---|---|
| Bleaching Solution | |
| N-bromocaprolactam | 6 g |
| Isopropyl alcohol | 110 g |
| Water | 15 ml |

The optical transmission density of the amplitude hologram was 2.8, and the diffraction efficiency was 38%. A light resistance test was carried out using the same exposing apparatus as described in Example 1 at the same conditions except exposing for 30 minutes, no blackening or change in diffraction efficiency was observed.

EXAMPLE 5

An amplitude hologram was obtained in the same manner as described in Example 1, and then bleached for 30 minutes at room temperature in a bleaching solution having the following composition.

| Bleaching Solution | |
|---|---|
| N-bromoketomorpholine | 4.3 g |
| Ethylene glycol monomethyl ether | 90 g |
| Water | 30 ml |

The optical transmission density of the amplitude hologram was 3.1, and the diffraction efficiency was 40%. A light resistance test was carried out using the same exposing apparatus and conditions as described in Example 1 except exposing for 30 minutes; no blackening or change in diffraction efficiency was observed.

EXAMPLE 6

An amplitude hologram was obtained in the same manner as described in Example 1, and then bleached in a bleaching solution having the following composition for 20 minutes at room temperature.

| Bleaching Solution | |
|---|---|
| N-bromo-2-pyrrolidone | 10.5 g |
| Acetone | 80 g |
| Water | 20 ml |

The optical transmission density of the amplitude hologram was 2.9, and the diffraction efficiency was 37%. A light resistance test was carried out using the same exposing apparatus and conditions as described in Example 1 except for exposing for 30 minutes; no blackening or change in diffraction efficiency was observed.

EXAMPLE 7

An amplitude hologram was obtained in the same manner as described in Example 1, and then bleached in a bleaching solution having the following composition for 20 minutes at 25° C.

| Bleaching Solution | |
|---|---|
| N-chlorophthalimide | 75 g |
| Methyl alcohol | 50 g |
| Dimethylformamide | 50 g |
| Water | 25 ml |

The optical transmission density of the amplitude hologram was 3.1, and the diffraction efficiency was 40%.

A light resistance test was carried out using the same exposing apparatus and conditions as described in Example 1 except for exposing for 30 minutes; a slight blackening was observed, and the diffraction efficiency decreased to 30%. However, the light resistance of the phase hologram was far superior to those obtained by conventional methods (e.g., ferricyanide method, mercury (II) chloride method, copper bromide method, ammonium dechromate method, etc.).

While the invention has been described in detail and with reference to specific embodiments thereof, it will be apparent to one skilled in the art that various changes and modifications can be made therein without departing from the spirit and scope thereof.

What is claimed is:

1. A method for producing a phase hologram by bleaching a silver image of an amplitude hologram formed on a light sensitive silver halide photographic material, wherein said amplitude hologram is produced by exposing a light sensitive silver halide photographic material to reference and object beams of electromagnetic radiation to which the silver halide photographic is sensitive, developing the exposed material and fixing the developed material and wherein said bleaching is conducted using a bleaching solution containing one or more N-halogeno compounds represented by the following general formulae (I) and (II)

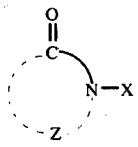

(I)

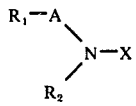

(II)

wherein X represents a halogen atom, SCN or CN; Z represents the atoms necessary for forming a five- or six-membered ring which may be condensed with another ring; A represents a carbonyl or sulfonyl group; and $R_1$ and $R_2$ represent an alkyl group, aryl group or alkoxyl group.

2. The method of claim 1, wherein the bleaching solution comprises at least (a) one N-halogeno compound, (b) a solvent for said N-halogeno compound, and (c) a swelling agent for the binder of the hologram layer which is miscible with (b).

3. The method of claim 2, wherein the amount of the N-halogeno compound ranges from 0.2 to 20% by weight of the weight of components (b) and (c).

4. The method of claim 2, wherein the solvent (b) comprises one or more members selected from the group consisting of methanol, ethanol, propanol, isopropanol, toluene, benzene, xylene, cyclohexane, isoamyl acetate, ethyl acetate, ethylene bromide, n-heptane, isooctane, mesitylene, trichloroethylene, acetone, dimethylformamide, ethylene glycol monomethyl ether, and glycerol.

5. The method of claim 1, wherein said bleaching solution comprises (i) at least one N-halogeno compound, (ii) at least one of methanol, ethanol, isopropanol, acetone, dimethylformamide, ethylene glycol monomethyl ether and glycerol, and (iii) water.

6. The method of claim 1, wherein the bleaching is carried out for not less than 5 minutes.

7. The method of claim 1, wherein the amount of swelling of the binder of the hologram layer during the bleaching is about two to about three times the volume of the binder in the dry state.

8. The method of claim 1, wherein said five- or six membered ring comprises one or more members selected from the group consisting of a pyrrole ring, a pyrrolidine ring, an imidazole ring, an imidazoline ring, an imidazolidine ring, a pyrazole ring, a pyrazoline ring, a pyrazolidine ring, a triazole ring, a tetrazole ring, a piperidine ring, an oxazine ring, a thiazine ring, a piperazine ring, a hydantoin ring, a cyanur ring, a thiohydantoin ring, a hexahydrotriazine ring, an indole ring, an indoline ring, an isoindole ring, a benzimidazole ring, a carbazole ring, a phenoxazine ring and a purine ring.

9. The method of claim 1, wherein said N-halogeno compound is selected from the group consisting of N-bromosuccinimide, N-bromotetrafluorosuccinimide, N-bromophthalimide, N-bromoglutarimide, 1-bromo-3,5,5-trimethyl-2,4-imidazolidinedion, 1,3-dibromo-5,5-dimethyl-2,4-imidazolidinedion, N,N'-dibromo-5,5-diethylbarbituric acid, N,N'-dibromo-barbituric acid, N-bromoisocyanuric acid, N-bromoacetamide, N-bromochloroacetamide, N-bromotrifluoroacetamide, N-bromoacetanilide, N-bromobenzenesulfonylanilide, N-bromobenzamide, N-bromobenzenesulfonylamide, N-bromo-N-benzenesulfonylbenzenesulfonylamide, N-bromophthalazone, N-chlorosuccinimide, N-iodosuccinimide, trichloroisocyanuric acid, N-chlorophthalimide, 1,3-dichloro-5,5-dimethyl-2,4-imidazolidinedion, 3-chloro-5,5-dimethyl-2,4-imidazolidinedion, 1,3-diiodo-5,5-dimethyl-2,4-imidazolidinedion, trichloromelamine, tribromomelamine, N-bromocyclohexanedicarbonimide, 1-bromo-3,5,5-triethyl-2,4-imidazolidinedion, 1-bromo-3-ethyl-5,5-dimethyl-2,4-imidazolidinedion, 1,3-dibromo-5,5-diethyl-2,4-imidazolidinedion, N,N-dibromo-5,5-dimethylbarbituric acid, N,N-dibromo-5-ethyl-5-methylbarbituric acid, N,N-dibromo-5-ethyl-5-phenylbarbituric acid, N,N'-dibromoisocyanuric acid, N-bromobromoacetamide, N-bromonaphthoamide, N-bromohydroxybenzamide, N-bromocarboxybenzamide, N-bromotoluenesulfonamide, N-bromo-N-toluenesulfonylamide, 1-bromo-3,5,5-trimethyl-2,4-imidazolidinedion, 1-bromo-3,5,5-triethyl-2,4-imidazolidinedithion, 1-bromo-3-ethyl-5,5-dimethyl-2,4-imidazolidinedithion, 1,3-dibromo-5,5-dimethyl-2,4-imidazolidinedithion, 1,3-dibromo-5,5-diethyl-2,4-imidazolidinedithion, 1,3-dichloro-5,5-dimethyl-2,4-imidazolidinedithion, 3-chloro-5,5-dimethyl-2,4-imidazolidinedithion, 1,3-diiodide-5,5-dimethyl-2,4-imidazolidinedithion and N-bromosaccharin.

10. The method of claim 1, wherein said N-halogeno compound is capable of forming a small amount of halogen radicals in an organic solvent.

11. The method of claim 1, wherein said alkyl and alkoxyl groups for $R_1$ and $R_2$ have 1 to 12 carbon atoms, said aryl group is a phenyl or naphthyl group and X is chlorine or bromine.

* * * * *